United States Patent [19]

Harkins

[11] Patent Number: 5,003,850

[45] Date of Patent: Apr. 2, 1991

[54] SCREWDRIVER WITH HOLDING SLEEVE

[76] Inventor: James J. Harkins, 300 N. River Rd. #310, Manchester, N.H. 03104

[21] Appl. No.: 521,411

[22] Filed: Jun. 4, 1990

[51] Int. Cl.[5] ..... B25B 23/00

[52] U.S. Cl. ..... 81/436; 81/177.1; 81/184

[58] Field of Search ..... 81/177.1, 180.1, 436, 81/28–37, 73, 489, 184

[56] References Cited

U.S. PATENT DOCUMENTS

| | | | |
|---|---|---|---|
| 432,928 | 7/1890 | Bartlett | 81/436 |
| 460,256 | 9/1891 | Steward | 81/73 |
| 1,474,236 | 11/1923 | Byrne | 81/73 X |
| 3,388,622 | 6/1968 | Klang | 81/73 X |

FOREIGN PATENT DOCUMENTS

| | | | |
|---|---|---|---|
| 305920 | 2/1933 | Italy | 81/73 |

*Primary Examiner*—D. S. Meislin

[57] ABSTRACT

A screwdriver has a handle and a bit attached to a shaft. A tubular sleeve surrounds the shaft of the screwdriver and engages a bearing surface on the bit. A user gripping the handle with one hand and the sleeve with the other hand maintains the bit in contact with the workpiece.

1 Claim, 1 Drawing Sheet

SCREWDRIVER WITH HOLDING SLEEVE

1(d) (1) TECHNICAL FIELD

This invention relates to improvements in screw drivers or other hand held tools designed for efficient tightening and loosening of screw-type fasteners.

1(d) (2) BACKGROUND ART

Tightening and loosening screw-type fasteners requires engaging the fastener with the appropriate tool while gripping and regripping the handle of the tool, often causing loss of engagement between the tool and fastener. As a result, the fastener, surrounding surfaces and tool may be damaged, and the process looses efficiency.

1(e) SUMMARY

The screw driver with holding sleeve is an adaptation which allows two hands to be used in the tightening and loosening process, as is customary, one hand turns the tool and hence the fastener. This invention allows the other hand to assist in maintaining positive engagement between the tool and fastener by providing a means of transmitting a longitudinal force toward and through the fastener without affecting tool rotation. The engagement will not be disturbed by subsequent regripping of the tool hand.

1(f) DESCRIPTION OF DRAWINGS

Figure 1:
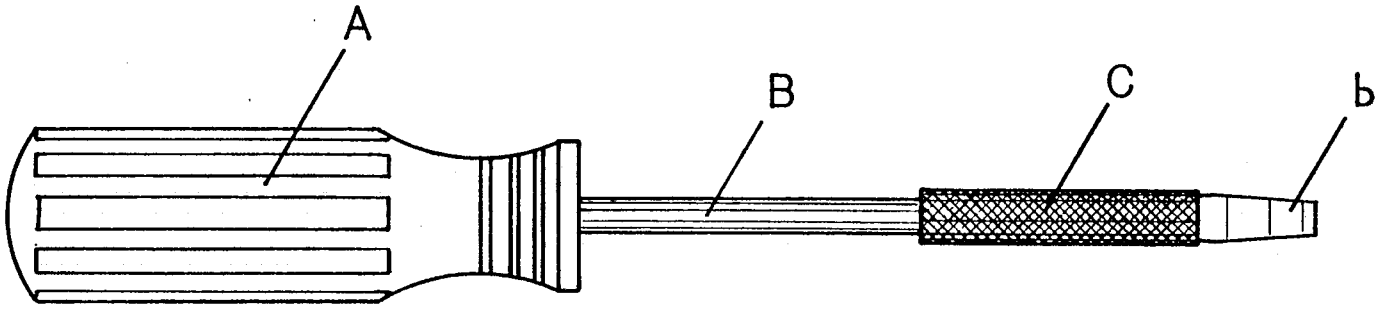

FIG. 1 Elevation of screw driver with holding sleeve

Figure 2:
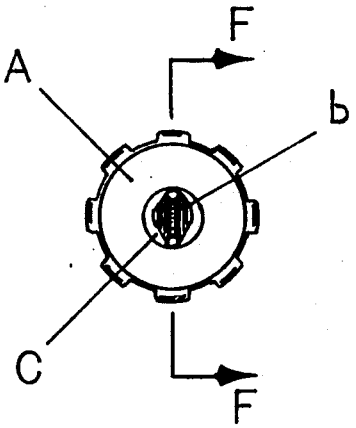

FIG. 2 End view as seen from right of FIG. 1

Figure 3:
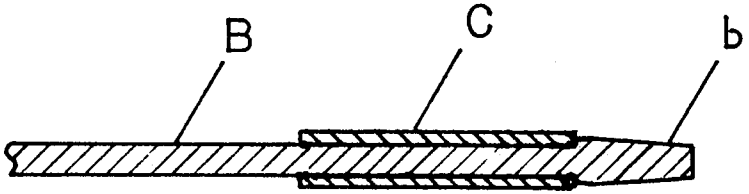
Figure 4:
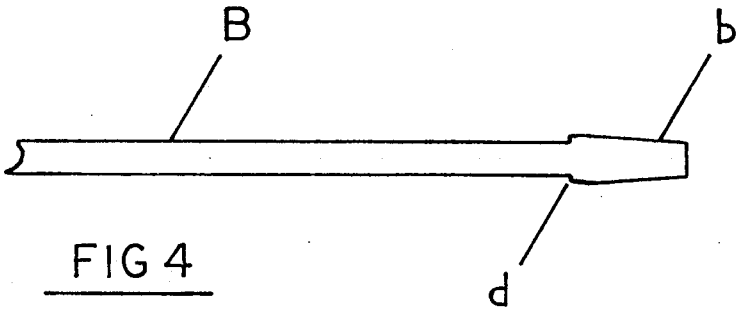

FIG. 3 Detail of shaft, cross-sectional view F—F (FIG. 2) shown with handle "A" removed FIG. 4 Detail of shaft illustrating hub or shoulder feature "d", handle "A" and sleeve "C" removed.

1(g) DESCRIPTION OF PREFERRED EMBODIMENT

This description refers to features illustrated in FIGS. 1, 2, 3 and 4.

The adapted tool generally retains the characteristics of a common screw driver. A handle "A" for gripping the tool and application of torque, a bit or blade "B" on other end effector for fastener engagement, and a shaft "B" for transferring rotational and longitudinal forces between the handle "A" and end effector "B".

The invention is an adaptation of a sleeve "C" to the shaft "B" of a screw driver. The sleeve "C" is coaxially fixed to the shaft "B" in such a way as to permit free rotation of the shaft "B" relating to the sleeve "C" and allowing the sleeve "C" to come to rest against a shoulder or hub "D" which is part of, or fixed upon the shaft "B". Forcing the sleeve "C" toward and against the shoulder "D" will transmit a longitudinal force in the direction of the working end (i.e., blade "B") of the tool without impairing rotation.

The user would grip the handle "A" in one hand and the sleeve "C" with the fingers of the other hand. The sleeve "C" would be positioned in such a way as to seat the sleeve against the shoulder "D" and in so doing transmit a longitudinal force assuring positive engagement and alignment with the fastener. The user may maintain his force upon the sleeve "C" and complete the tightening/loosening process without disengaging the tool from the fastener as the tool handle "A" is regripped with the other hand repeatedly during the process.

I claim:

1. A screwdriver having a shaft extending along a longitudinal rotational axis, a bit attached to one end of said shaft and extending along said longitudinal rotational axis, a handle attached to a second end of said shaft and extending along said longitudinal rotational axis, a tubular sleeve being co-axial with said shaft and slidable thereon, said bit having a shoulder formed with a bearing surface thereon for engagement with one end of said sleeve; said shaft, bit, and handle being rotatable relative to said sleeve about said longitudinal rotational axis.

* * * * *